United States Patent [19]

Sutryn et al.

[11] Patent Number: 4,550,825

[45] Date of Patent: Nov. 5, 1985

[54] MULTICOMPARTMENT MEDICAMENT CONTAINER

[75] Inventors: Caroll S. Sutryn, Montoursville; Michael G. Maietta, Cogan Station, both of Pa.

[73] Assignee: The West Company, Phoenixville, Pa.

[21] Appl. No.: 517,579

[22] Filed: Jul. 27, 1983

[51] Int. Cl.[4] ..... B65D 3/04

[52] U.S. Cl. ..... 206/222; 206/219; 206/221; 383/38; 383/96

[58] Field of Search ..... 256/219, 220, 221, 222; 383/80, 96, 38

[56] References Cited

U.S. PATENT DOCUMENTS

| | | | |
|---|---|---|---|
| 2,275,567 | 3/1942 | Smith | 206/221 |
| 2,642,870 | 6/1953 | Smith | 206/222 |
| 2,653,610 | 9/1953 | Smith | 206/222 |
| 2,653,611 | 9/1953 | Smith | 206/222 |
| 2,793,776 | 5/1957 | Lipari | 206/221 |
| 3,595,439 | 7/1971 | Newby | 206/63.5 |
| 3,951,148 | 4/1976 | Herb | 383/80 |
| 4,102,451 | 7/1978 | Clarke et al. | 206/219 |
| 4,258,845 | 3/1981 | Potts | 206/221 |
| 4,267,923 | 5/1981 | Crankshaw et al. | 206/221 |
| 4,467,588 | 8/1984 | Carveth | 604/87 |

FOREIGN PATENT DOCUMENTS

| | | | |
|---|---|---|---|
| 577917 | 7/1976 | Switzerland | 383/96 |

*Primary Examiner*—William T. Dixson, Jr.
*Assistant Examiner*—Brenda J. Ehrhardt
*Attorney, Agent, or Firm*—Eugene E. Renz, Jr.

[57] ABSTRACT

A composite package adapted for initially separately containing a dry medicament and a diluent therefor, the diluent containing package portion being a collapsible bag with an I.V. set fitment attachment port and an injection port, and a dry medicament containing receptacle container, the dry medicament container including an open end cylinder sealingly engageably mountable in a top opening in the collapsible bag, the cylinder having an elastomeric bottom closure plug therein, a top plunger means constituting a top cylinder closure and a final seal for the container, the plunger being depressible within the cylinder, and operable to displace the bottom closure plug to open the cylinder bottom for discharge therefrom, and subsequent mixing of, the dry medicament in the diluent in the collapsible bag for subsequent disbursement of the mixture therefrom.

6 Claims, 7 Drawing Figures

44
50
72
28
10
12
40
42
38
36
32
16
14
3
34
52
54
30
76
18
22
20
46
68
66
58
64
62
60
70
74
56

MULTICOMPARTMENT MEDICAMENT CONTAINER

TECHNICAL FIELD

The invention relates broadly to medicament dispensing containers, and more particularly to a multicompartment, large volume I.V. container, initially preferably having a dry medicament in one separate sealed compartment and a diluent therefor in a second separate sealed compartment.

Multicompartment containers broadly are known in the art. The known type however, have generally not been used in connection with I.V. administration, and did not include separately fillable and content inspectable compartments in a collapsible type dispensing container of this nature. Selective storage of a dry medicament in a container including a sealed medicament compartment, and a flexible container having a diluent for mixing with the medicament in a sterile, non-contaminated condition for I.V. dispensing or hypodermic removal is the main field and use of the present invention.

The disclosure in the present application accordingly will disclose and describe preferred embodiments of specific structures of multicompartment containers of this type. Manifestly, some minor detail changes will be apparent to those skilled in the art and without departing from the scope of the invention.

BACKGROUND OF THE INVENTION

Multicompartment containers adapted for initially holding in separate compartments, two or more substances for materials such as medicaments, either liquid or dry, and a diluent or carrier solution therefor, have been known and used.

Specific examples of containers of this general nature are disclosed in U.S. patents issued to Arthur E. Smith, U.S. Pat. Nos. 2,653,610 and 2,653,611. These two patents disclose broadly the concept of a two compartment container for medicament products wherein a dry powder medicament and diluent therefor are initially separated or isolated from one another, and means are provided for so activating the container as to mix the dry and liquid components for subsequent utilization in known manners.

This prior art and particularly in the principal embodiment of U.S. Pat. No. 2,653,610 includes a container such as a bottle having a body portion within which the diluent is housed and a reduced neck portion 13. The dry powdered or crystalline medicament or drug is housed in a stopper which is inserted in the top opening of the bottle. A closure is placed over the stopper to complete the package. When it is desired to prepare, for example, a fresh drug solution, the stopper or top and a stem mounted therebelow within the dry medicament container are adapted to be pushed or forced downwardly. The bottom of the dry medicament container consists of a fracturable diaphragm. When the top and stem are pushed downwardly, the diaphragm is fractured and the stem, together with a section of the fractured diaphragm fall into the diluent solution in the container.

In this known type of container, it will be seen that the resultant mixture is possibly contaminated by a portion of the fractured or ruptured diaphragm together with the stem which are conjointly displaced and fall into the liquid diluent. Such contamination is undesirable and can result in difficulties of utilization of the liquid mixture and/or cause a deterioration or other type of contamination thereof.

It is also to be noted that the dispensing closures of these two Smith patents are of a construction which prevents the diluent and dry medicament product to be packaged or filled separately, and further the structure in these patents prevents inspection of the independent compartments prior to assembly of a dry medicament compartment within a collapsible bag such as a plastic I.V. container. The separate packaging concept which permits the separate filling prior to joinder of the two compartments, and permits a separate inspection of the independent compartment, further increases the shelf life of the overall package and the material or substance contained therein by isolating the diluent and dry drug in a guaranteed fashion.

As aforementioned, the present invention is directed to a multiple compartment, preferably large volume, I.V. container having new and improved structure and outstanding improvements in the overall formation and subsequent use thereof.

In the preferred embodiment hereinafter described in detail and as shown in the drawings, the basic concept of the invention is disclosed. A separate dry medicament or drug container is formed by utilizing an open-ended cylinder which can consist of a plastic material, or a composite of a plastic material cylinder within which a glass cylinder is inserted, the cylinders being open-ended. A resilient closure plug is fitted into the interior of the inner cylinder in a composite structure, or the single plastic cylinder, and forms a bottom closure therefor. The material is composed of a suitable elastomeric material such a rubber, neoprene, plastic, butyl rubber and the like and has a sufficient thickness and resilience to initially seal the bottom of the open end cylinder and permit introduction of, for example, a dry medicament material into this container as a separate medicament holding container. The use of the plastic outer cylinder or sleeve, or a plastic exterior surface in a composite construction, facilitates adhering of this container in an opening into an I.V. container which, as is well known, is generally of a flexible transparent plastic material. The adhesion or fixing can utilize suitable adhesives, heat sealing and/or other known methods. When a glass inner cylinder is utilized a greater immunity to reaction with certain medicaments is obtained.

An upper plug of a suitable structure and material is inserted in the interior of the top sleeve above the medicament container therein. This compartment accordingly is variable for containment of varied amounts of materials. A plunger which can vary in construction, and having a push rod adjoined thereto, and which extends outwardly from the medicament compartment or container, upon being depressed will displace the bottom plug or seal by compression of the air or contact with the top of the medicament. The plug closing the bottom of the compartment is accordingly discharged into the diluents containing bag and it is to be noted that no fragmentation of the container results. The materials used permit separate filling of the dry medicament compartment or container, which is thereafter placeable within the top opening of the I.V. bag and appropriately sealed therein. As will appear hereinafter, certain modifications can be utilized, such as for example the use of a lyophilization plunger or upper stopper can be used.

The push rod and stopper can be so joined that the plunger, following actuation to discharge material into the bag, will still serve as a seal to maintain complete sterility of the material within the bag following mixing.

Other objects and advantages of the present invention will become readily apparent to those skilled in the art from the following detailed description, wherein there is shown and described preferred embodiments of the invention, simply by way of illustration of currently preferred and contemplated modes for carrying out the invention. As will be realized, the invention is susceptible to other and specific embodiments, materials, and details are capable of modification in various, obvious respects, all without departing from the invention. Accordingly the drawings and description are to be regarded merely as illustrative in nature, and not as restrictive.

DETAILED DESCRIPTION OF THE DRAWINGS

Figures 1, 2, 3, 4:
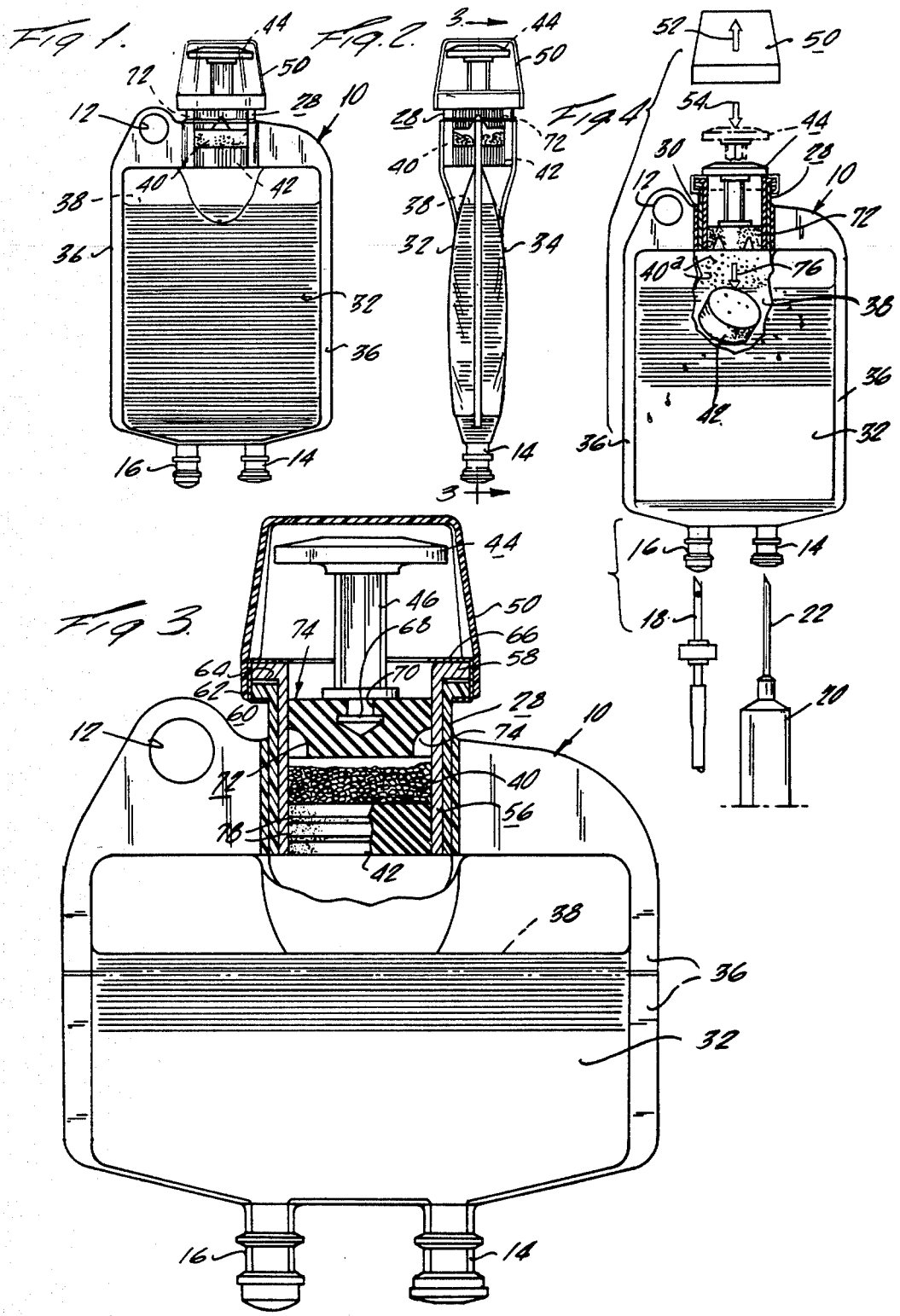
FIG. 1 is a front elevation view of one form of the invention.
FIG. 2 is a side elevational view taken at right angles to the showing of FIG. 1.
FIG. 3 is an enlarged fragmentary front elevational sectional view, with some portions broken away, taken generally along line 3—3 of FIG. 2.
FIG. 4 is a view similar to FIG. 1 depicting actuation of the container of the present invention, the showing being exploded for clarity of action and function.

Referring now to the details of the drawings, there is shown in FIG. 1, a so-called large volume, multicompartment, I.V. container generally designated 10, which as usual consists of a plastic flexible material of a flattened bag-like configuration. A mounting opening 12 is provided for hanging on a usual I.V. stand or the like. The bag includes, as is usual, an addition port 14 and discharge port 16 adapted for connection with or into an I.V. dispensing system, the spike or needle of which is shown fragmentarily at 18 in FIG. 4. A hypodermic syringe is fragmentarily shown at 20 having a needle 22 which can be inserted into the interior of bag 10 by the puncturing of a diaphragm or closure member within on the port 14. This can be used as withdrawal means or for adding a portion of a substance to the container. The I.V. spike 18, incorporated into an I.V. system fragmentarily shown at 26 in FIG. 4 is of a usual type.

The essence of the present invention resides in a combination of a separate dry medicament container or compartment 28 which is adapted for insertion within a top opening 30 of a joinder usual type of I.V. bag or container 10. (see FIG. 6) The I.V. bag or container 10, as hereinbefore set forth, consists of transparent flexible plastic material consisting essentially of parallel sides 32, 34 welded or affixed to one another along joining edge portions 36 by heat sealing or the like in a usual manner. This bag is a separate entity or compartment for containing a liquid diluent as at 38, adapted for mixing with a dry medicament powder or the like 40, which is held in the separate medicament compartment or container 28.

In use, the two separate compartments 28 for the dry medicament and the bag 10 for the liquid diluent, are separately filled with the respective materials to be contained. This filling can be effected separately and the materials utilized for the two compartments permits inspection of the contents therein both prior to assembly of the two into the completed two compartment member or subsequent to their joinder. The filled and the joined condition is shown in FIGS. 1 and 2 of the drawings. The operation and/or functional use of the two compartment container is pictorially represented in FIG. 4 wherein the dry medicament compartment or container 28 has been mounted within the top opening 30 of bag 10 and sealed therein, as will be herinafter explained in greater detail. FIG. 4 discloses the container following action to displace a lower sealing plug 42 from the lower portion compartment 28 by application of pressure on a combination push rod assembly 44 having a depending stem 46 thereon. The assembly additionally includes a top 48 which is shown in broken lines in a raised or inactive position prior to joining of or mixing of the dry medicament in the diluent. A dust cover or cap 50 is adapted to surround the push rod assembly in a storing unactivated condition. Prior to activation, the cap 50 is removed, as indicated by arrow 52, and subsequent downward pushing of the assembly 44 is indicated by arrow 54.

Figure 5:
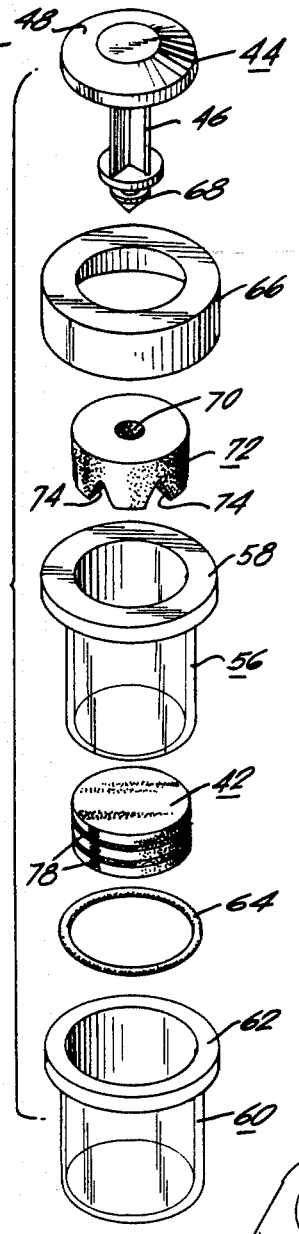
FIG. 5 is an exploded perspective view of one form of container for the dry medicament and the various elements constituting the same.
Figure 6:
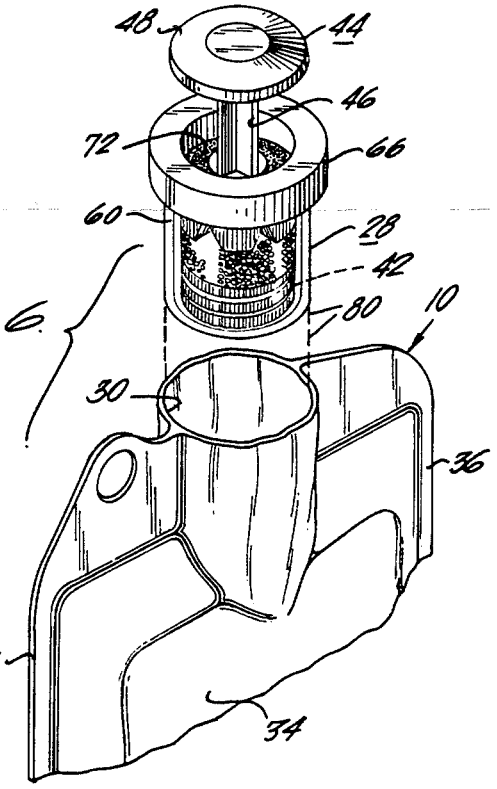
FIG. 6 is an exploded perspective view, the I.V. bag being fragmentarily shown, disclosing the separate aspect of the two compartments and depicting schematically the of the separate medicament container of FIG. 5 with respect to the flexible diluent container.
Figure 7:
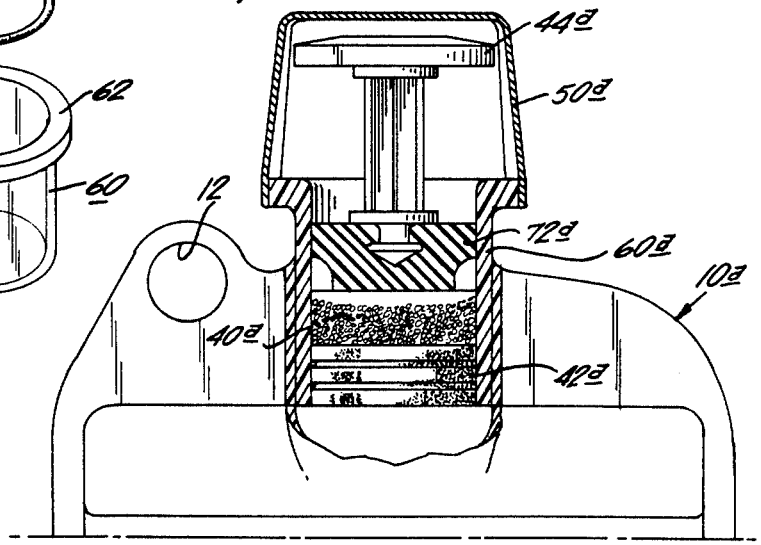
FIG. 7 is a fragmentary front elevational view, partially in section, of a modified form of upper closure and stopper mechanism wherein the inner glass cylinder is eliminated and the dry medicament container consists solely of a plastic material.

In the embodiment disclosed in detail in FIGS. 1–6 inclusive, the dry medicament compartment and actuation mechanism differs slightly from the embodiment shown in FIG. 7. In this first embodiment the dry medicament compartment includes an inner cylinder 56 consisting of glass having a top flange 58 which is outwardly turned, and this glass cylinder or sleeve is interfitted in or encased by a plastic material sleeve or cylinder 60, likewise having an upper outwardly turned flange 62. A sealing gasket 64 is interposed between the upper flange of member 60 and underside of the flange on member 56 as shown in FIG. 3. An aluminum sealing member or joining member 66 co-acts with the outwardly turned flange members to hold the two sleeves together. The member 66 is swaged over and around the outstanding tops.

As hereinbefore mentioned, the material of the I.V. bag consists of a plastic and in the embodiment, referring to FIG. 4, the outer plastic sleeve or cylinder is affixed in top opening 30 of the bag by heat sealing, for example, of compatible plastic materials. Obviously, if desired, adhesive could be applied between these members.

The bottom or lower closure plug 42, consisting of a resilient material, is forcibly inserted within the lower end of the glass sleeve or inner cylinder 56 as shown in FIG. 3. The dimensions and material will sealingly close the lower end of the inner sleeve. The dry medicament or powder 40 is then placed within the dry medicament compartment 28 and rests upon the closure plug 42. The construction is such that different amounts of the medicament 40 can be placed within this separate container or compartment therefor, and which can be pre-prepared prior to it's joinder with the bag 10, and following completion by insertion of the push rod assembly.

The push rod assembly 44 has a lower interconnecting end member 68 having a particularly configured bottom end as shown in FIG. 3, for example, which inter-engages within a comparable recess 70 formed in a plunger or stopper 72 which likewise is formed from a resilient sealing material. The plunger or stopper 72, following joinder with the fitment or connecting end member 68 is placed within the open upper end of the inner glass sleeve or cylinder 56 as indicated at 74 in FIG. 3, and sealingly closes the upper end of dry medicament compartment 28.

In one practical embodiment of the invention, this stopper or plug 72 can consist of a lyophiilization plunger, known in the art and having in a usual manner vent openings 74 in the lower edge thereof. Such a stopper or plunger is utilized in preparation of or utilization of a dry freeze method of medicament insertion and sealing or closure in the dry medicament compartment in a manner known in the art. The openings 74 permit ventilation during closure and actuation process.

When it is desired to mix the dry medicament 40 within the diluent 38 in the diluent compartment, which can be separately filled with the required amount of diluent prior to joinder or interconnection of the dry medicament compartment, and the material of the bag permitting separate inspection thereof, the push rod assembly 44 is pressed downwardly from the dotted line showing in FIG. 4 to the full line showing therein. The air medium between plunger 72 and the medicament will cause displacement of the bottom plug 42 as indicated by arrow 76 in FIG. 4. This opens the dry medicament compartment to permit particles **40*a* to fall into the liquid diluent 38, and upon manipulation of the bag the two materials will be intermixed in a known manner. This action is pictorially presented in FIG. 4 of the drawings. Utilization of the so prepared mixture will be apparent by reference to the members 20 and 18** in this Figure.

The actual constructional features and details of the push rod assembly are clearly depicted in the exploded showing of FIG. 5. Attention is however, invited to the lower closure plug 42. As herinbefore mentioned, this plug is formed of a resilient material usable to effect a seal within the inner glass sleeve. This construction can preferably include a plurality of peripheral grooves 78, which enhance the sealing placement and actuation of the stopper within the bottom of the glass cylinder holding the dry medicament in the dry medicament chamber, by forming external ribs.

The pre-assembled condition of the dry medicament compartment 28 is shown in the exploded view of FIG. 6. This completion of the separate dry medicament chamber or container, as hereinbefore mentioned, prior to joinder in the top opening 30 of bag 10 permits separate filling and visual inspection of the dry medicament and the condition of the compartment 28. In assembly, the liquid diluent is separately placed within the I.V. bag or container 10, and can consist of the desired material and measured quantity thereof. The material of the I.V. container bag permits inspection of the diluent subsequent to filling thereof. After the diluent is so placed, the dry medicament compartment 28 is placed within the top opening as indicated by dashed lines 80 in FIG. 6 and a heat sealing joinder or the like takes place.

A modified form of the invention is shown in FIG. 7. For facilitating an understanding of the differences, the same portions or members in the first embodiment are given the same designation with the subscript a thereon. The structure includes the dust cover **50*a*, the push rod assembly 44*a* including a plunger or stopper 72*a* interconnected thereto. In this embodiment however, the inner glass cylinder is omitted and the outer plastic cylinder of a desired material is used, as shown at 60*a*. The material must be such that interaction with the medicament 40*a* will not occur. Again the bottom plug 42*a* seals the lower end of plastic sleeve 60*a***. Operationally this embodiment is similar to the aforedescribed embodiment.

It will accordingly be seen that the present invention provides a new and improved multicompartment medicament container including separately fillable and connectable dry medicament containers and liquid diluent containers, having a highly efficacious manner of sealing and operation. Separate filling of the two compartments and easy inspection thereof and contents therein are available. Fragmentation of a closure diaphragm or sealing membrane is overcome and small particles thereof are prevented from interferring with proper utilization of the mixed medication in the bag.

It is seen that the present invention accordingly overcomes problems existing with prior art structures and constitutes a substantial contribution to the art.

While specific and particular configurations and constructions are shown in the drawings, minor variations therein will be obvious to those skilled in the art without departing from the spirit of the invention. Such obvious changes or modifications are considered to be within the scope of the inventive concept as expressed herein, and as claimed hereinafter.

What is claimed is:

1. A multicompartment medicament container comprising a dry medicament compartment and a liquid diluent compartment, said compartments being discrete and separately selectively filled respectively with a dry medicament and a liquid diluent, said compartments being separately respectively inspectable for determining contents and conditions therein, said compartments being superposedly joined and thereby constituting a multicompartment container, said dry medicament compartment including a double open ended cylinder consisting of an inner glass material cylinder inert to said dry medicament and an outer plastic material cylinder, said plastic outer cylinder attached by sealing in an opening in said liquid diluent compartment and thereby forming said multicompartment medicament container assembly, a slidably removable bottom sealing and closure means in said inner glass cylinder, and plunger means operable for axial sliding movement therein from a first position adjacent one end of said inner cylinder to a second position at the opposite end of said inner cylinder directly communicating with said diluent compartment to expel said bottom sealing and closure means out through a bottom of said cylinder open end as an entity, for free displacement thereof into said diluent compartment, and complete discharge of the dry medicament through said bottom open end into said diluent for intermixing therewith.

2. A multicompartment medicament container as claimed in claim 1, said container comprising a two-compartment large volume I.V. container.

3. A container as claimed in claim 1, said open-ended cylinder comprising said dry medicament compartment being formed of a material non-reactive with a dry medicament therein, said removable bottom sealing and closure means comprising a plug of resilient material, resiliently engaged within said cylinder proximate the bottom thereof and adapted to support said dry medicament, an upper plunger and sealing disc in said cylinder spaced above said bottom plug, and forming therebetween said dry medicament compartment, said disc being selectively depressible and thereby operable to compress gaseous medium within said compartment and to dislodge said bottom closure and sealing plug from said cylinder.

4. A container as claimed in claim 3, said upper plunger sealing disc having an extended stem and an actuating top member thereon and being adapted for downward displacement for depressing said upper plunger sealing disc for sliding displacement of said bottom closure and sealing plug through said bottom open cylinder end.

5. A container as claimed in claim 1, said glass and said plastic cylinders respectively having top outwardly extending flanges thereon, a sealing gasket interposed between said flanges and seal means crimped about the top flanges for sealingly maintaining said sleeves joined.

6. A container as claimed in claim 1, wherein said liquid diluent compartment comprises a flexible and transparent I.V. type bag, said bag having an upper opening, said dry medicament compartment being insertable in and sealable in said opening, said bag further including a bottom addition port and a bottom spike receiving port for intravenous system connections.

* * * * *